US007543427B2

(12) United States Patent
Strauss

(10) Patent No.: US 7,543,427 B2
(45) Date of Patent: Jun. 9, 2009

(54) STIRRUP

(75) Inventor: Isidore Strauss, Clark, NJ (US)

(73) Assignee: Intec Corporation, Cliffwood, NJ (US)

( * ) Notice: Subject to any disclaimer, the term of this patent is extended or adjusted under 35 U.S.C. 154(b) by 483 days.

(21) Appl. No.: 11/325,222

(22) Filed: Jan. 4, 2006

(65) Prior Publication Data

US 2006/0168919 A1 Aug. 3, 2006

Related U.S. Application Data

(60) Provisional application No. 60/648,146, filed on Jan. 28, 2005.

(51) Int. Cl.
*B68C 3/02* (2006.01)

(52) U.S. Cl. ..... 54/49; 54/47

(58) Field of Classification Search ..... 54/47, 54/48, 49, 49.5

See application file for complete search history.

(56) References Cited

U.S. PATENT DOCUMENTS

| | | | | |
|---|---|---|---|---|
| 143,732 | A | 10/1873 | Thompson | |
| 545,796 | A | 9/1895 | Haddorf et al. | |
| 559,046 | A | 4/1896 | Turner | |
| 726,534 | A | 4/1903 | Hollicott | |
| 842,702 | A | 1/1907 | Reim | |
| 908,265 | A | 12/1908 | Ivey | |
| 1,758,930 | A | 5/1930 | Cameron | |
| 3,276,185 | A | 10/1966 | Jahn | |
| 4,281,503 | A | 8/1981 | Teel | |
| 5,172,538 | A | 12/1992 | Luger | |
| 6,220,004 | B1 * | 4/2001 | Hsi-Chang | 54/48 |
| 6,330,781 | B1 | 12/2001 | Meroth | |
| 6,629,405 | B2 | 10/2003 | Johnson | |
| 2003/0051448 | A1 | 3/2003 | Johnson | |

FOREIGN PATENT DOCUMENTS

| | | |
|---|---|---|
| CN | 2043973 | 11/1988 |
| CN | 2228483 | 6/1995 |
| DE | 25481 | 1/1884 |
| DE | 46706 | 8/1888 |
| DE | 96142 | 3/1897 |
| DE | 101058 | 6/1898 |
| DE | 113441 | 9/1899 |
| DE | 236525 | 3/1910 |
| DE | 8018934 | 10/1980 |
| DE | 8219267 | 8/1982 |
| DE | 3307152 | 1/1984 |
| DE | 3317859 | 11/1984 |
| FR | 330651 | 8/1903 |

(Continued)

*Primary Examiner*—Rob Swiatek
(74) *Attorney, Agent, or Firm*—King & Schickli, PLLC

(57) ABSTRACT

A flexible stirrup includes a base, a top, at least one flexible section connecting the base and the top, and a stabilizing hollow sheath enclosing at least a portion of the at least one flexible section. The flexible section includes at least one connector having a stem with a coupler at a first end and at a second opposed end thereof. The stem and first and second couplers may include at least one cross-sectional dimension that is substantially equal. At least a portion of an external surface of the at least one connector is in stabilizing contact with at least a portion of an internal surface of the hollow sheath.

17 Claims, 5 Drawing Sheets

FOREIGN PATENT DOCUMENTS

| | | |
|---|---|---|
| FR | 339248 | 2/1905 |
| FR | 349453 | 5/1905 |
| FR | 427793 | 8/1911 |
| GB | 1171 | 0/1913 |
| GB | 3389 | 0/1888 |
| GB | 4945 | 0/1885 |
| GB | 6943 | 0/1902 |
| GB | 8994 | 0/1903 |
| GB | 9979 | 0/1886 |
| GB | 20579 | 0/1890 |
| GB | 23985 | 0/1903 |
| GB | 1458742 | 12/1976 |
| SU | 1560465 | 4/1990 |
| WO | WO 95/25692 | 9/1995 |
| WO | WO 99/08957 | 2/1999 |
| WO | WO 00/30972 | 6/2000 |

* cited by examiner

STIRRUP

This application claims the benefit of priority in provisional patent application Ser. No. 60/648,146, filed Jan. 28, 2005, the disclosure of which is incorporated herein in its entirety by reference.

TECHNICAL FIELD

The present invention relates to a stirrup for use in equitation. In particular, the invention relates to a stirrup having a flexible section allowing the stirrup to flex in response to the movement of the rider's foot and ankle.

BACKGROUND OF THE INVENTION

In equitation, the stirrup is an essential element of the rider's equipment. The stirrup, in conjunction with the saddle, provides a stable platform for the rider. Accordingly, the rider is better able to maintain balance in the saddle, and all-around comfort and security are improved. With the use of the stirrup, the ability of the rider to stay mounted during the performance of complex riding maneuvers is greatly enhanced.

Conventional stirrups typically include an arcuate top portion, which is connected to a base portion for supporting the rider's foot. In general, conventional stirrups provide no flexibility or range of motion between the top portion and the base. Any flexibility afforded the rider when using a conventional stirrup is provided by the positioning and flexing of the rider's foot and ankle. This has the undesirable effect of holding the rider's foot and ankle in a single orientation, which is detrimental to rider comfort. For this reason, it is known in the art to provide a stirrup having means for imparting flexibility between the arcuate top portion of the stirrup and the base. By providing flexibility in the connection between the base and the top portion of the stirrup, the ability of the rider to flex the foot and ankle to hold the proper "heels-down" riding position is improved.

However, existing flexible stirrups only allow a limited range of motion, typically such that the base of the stirrup pivots relative to the top portion in a rocking or "see-saw" motion. Such a range of motion is suited for its intended purpose, and provides advantages in comfort over a conventional, non-flexible stirrup in allowing a rider to adopt the proper "heels-down" position. However, it would be advantageous to provide a stirrup with additional ranges of motion, preferably to provide additional freedom of movement of the rider's foot and ankle without allowing unrestricted movement. This would not only improve the ease of assuming the proper heels-down riding position, but also allow an ergonomically correct positioning of the lower leg and knee in accordance with the rider's individual needs, regardless of the movement of the horse.

In accordance with this need identified in the art, the present invention provides a stirrup having a flexible section connecting a top portion and a base, adapted to allow a range of motion in at least three directions. The stirrup of this invention allows a rocking or "see-saw" movement of the base relative to the top portion. Additionally, the present invention allows a rotating movement of the base relative to the top portion, which allows the rider's foot and/or ankle to similarly rotate while maintaining a secure contact between the rider's foot and the stirrup. Still further, the stirrup of the present invention allows lateral movement of the base relative to the top portion. This improved range of motion maximizes the flexibility afforded the rider to position his or her foot properly, and to more easily extricate his or her foot when needed, maximizing rider comfort and stability.

SUMMARY OF THE INVENTION

In accordance with the need identified in the art, in one aspect the present invention provides a flexible stirrup, comprising a base, a top, at least one flexible section connecting the base and the top, and a stabilizing hollow sheath enclosing at least a portion of the at least one flexible section. In one embodiment, the at least one flexible section comprises at least one connector comprising a stem having a first coupler at a first end and a second coupler at a second, opposed end. The at least one stem and first and second couplers may have at least one cross-sectional dimension that is substantially equal.

In another embodiment, the at least one flexible section comprises at least two connectors. In this embodiment, at least one of the at least two stems includes a first coupler held in a first plane, and a second coupler held in a second plane which is different from the first plane. The first plane may be substantially at a right angle relative to the second plane.

At least a portion of at least one of the top, the base, or the at least one connector may be in stabilizing contact with an internal surface of the hollow sheath. In one embodiment, at least a portion of the at least one connector is in stabilizing contact with at least a portion of the internal surface of the hollow sheath. The sheath may be fabricated of a flexible material having a Shore hardness value of at least 50.

In another aspect, a flexible section is provided for a stirrup, comprising at least two connectors comprising a unitary stem having a coupler at a first end and at a second opposed end. At least one of the at least two stems may include a first coupler oriented in a first plane and a second coupler oriented in a second plane which is different from the first plane. In one embodiment, the first plane may be substantially at a right angle relative to the second plane. Still further, the flexible section may include a stabilizing hollow sheath enclosing at least a portion thereof. At least a portion of at least one of the at least two connectors is typically in stabilizing contact with at least a portion of an internal surface of the hollow sheath. As noted above, the sheath may be fabricated of a flexible material having a Shore hardness value of at least 50. In one embodiment, the at least two stems and first and second couplers may include at least one cross-sectional dimension that is substantially equal.

In yet another aspect of the present invention, a flexible stirrup for equitation is provided, comprising a base, a top, and at least one flexible section connecting the base and the top. The at least one flexible section may comprise at least two coupled connectors, each comprising a unitary stem having a coupler at a first end and at a second opposed end. The stirrup may further comprise a hollow sheath stabilizing at least a portion of the at least one flexible section, wherein at least a portion of at least one of the top, the base, or at least one of the at least two connectors is in stabilizing contact with at least a portion of an internal surface of the hollow sheath. In one embodiment, at least a portion of the at least two connectors is in stabilizing contact with at least a portion of the internal surface of the sheath.

The stem and first and second couplers of each connector may include at least one cross-sectional dimension that is substantially equal. As noted above, the sheath may be fabricated of a flexible material having a Shore hardness value of at least 50. At least one of the stem and first and second couplers of each connector may have at least one external dimension sufficient to maintain a friction fit or interference fit between at least a portion of the connector external surface and at least a portion of the hollow sheath external surface. The hollow sheath, in one embodiment, encloses and stabilizes an entirety of the at least one flexible section.

In still yet another embodiment, the present invention provides a flexible stirrup for equitation, comprising a base for supporting a rider's foot, a top for connecting to a stirrup leather, and two laterally-spaced flexible sections connecting the base and the top. Each flexible section comprises at least two coupled connectors, wherein each connector comprises a unitary stem having a coupler at a first end and at a second opposed end. At least one of the least two stems may include the first coupler held in a first plane, and the second coupler held in a second plane which is different from the first plane. In one embodiment, the second plane is substantially at a right angle to the first plane. The stem and first and second couplers of each connector may optionally include at least one cross-sectional dimension that is substantially equal.

The stirrup may further include a hollow sheath stabilizing at least a portion of each flexible section. The sheath is typically fabricated of a flexible material having a Shore hardness value of at least 50. At least a portion of at least one of the top, the base, or at least one of the at least two coupled connectors may be in stabilizing contact with at least a portion of an internal surface of the hollow sheath. The stem and first and second couplers of each connector may include at least one external dimension sufficient to maintain a friction fit or interference fit between at least a portion of the connector external surface and at least a portion of the hollow sheath internal surface. In one embodiment, the hollow sheath encloses and stabilizes an entirety of each flexible section.

It should be appreciated that the embodiments shown and described herein are an illustration of one of the modes best suited to carry out the invention. It will be realized that the invention is capable of other different embodiments and its several details are capable of modification in various, obvious aspects all without departing from the invention. Accordingly, the drawings and descriptions will be regarded as illustrative in nature, and not as restrictive.

BRIEF DESCRIPTION OF THE DRAWING

The accompanying drawings incorporated in and forming a part of the specification, illustrates several aspects of the present invention, and together with the description serves to explain the principles of the invention. In the drawings.

Figure 1:
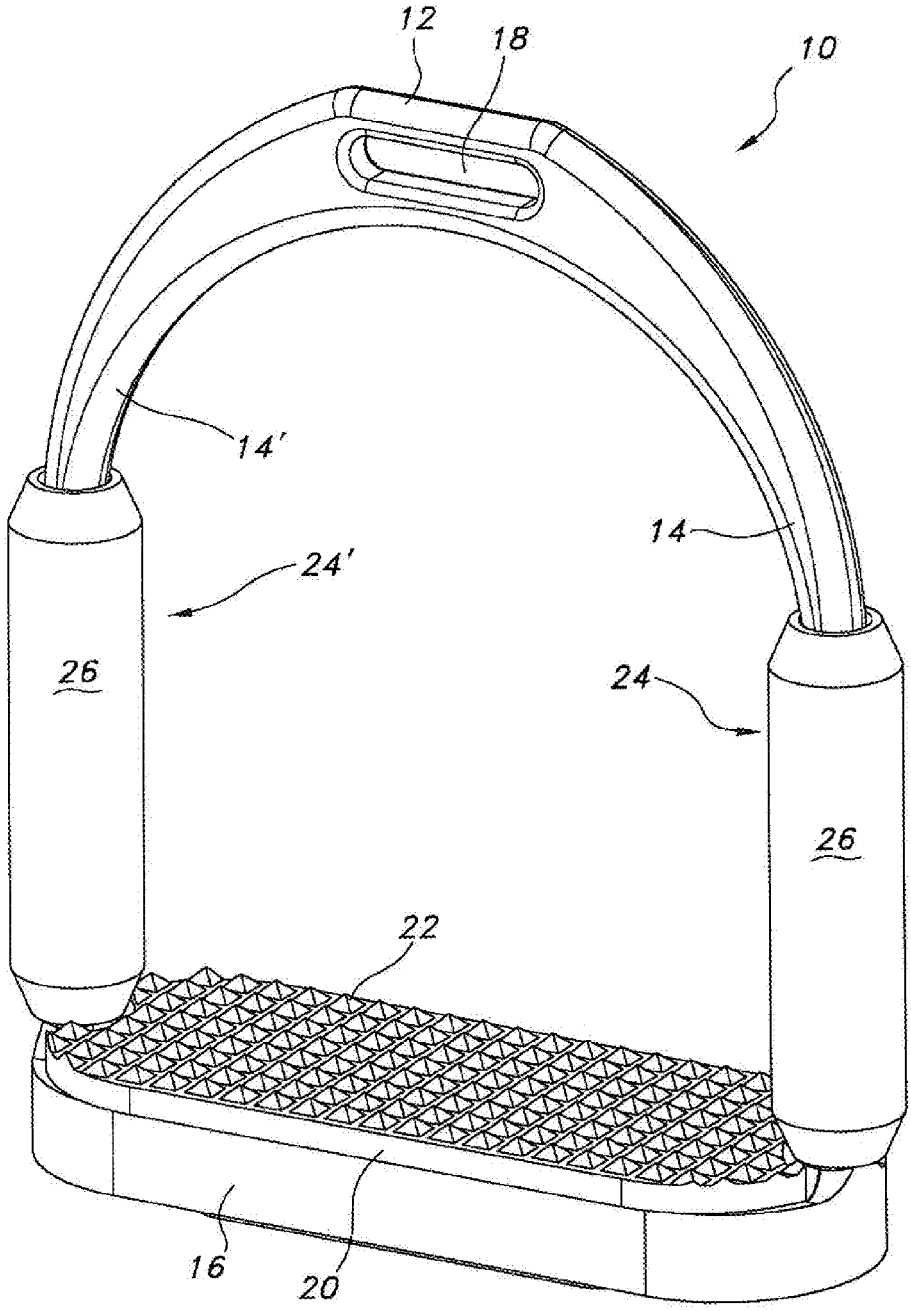
FIG. 1 is a perspective view of a stirrup in accordance with the teachings of the present invention.

Reference will now be made in detail to the best mode contemplated for carrying out the invention, examples of which are illustrated in the accompanying drawings. The examples are presented in support of and to further illustrate the invention as described herein. However, the invention is not to be considered as limited thereto.

DETAILED DESCRIPTION OF THE INVENTION

In accordance with the need identified in the foregoing description, the present invention provides a stirrup 10 of substantially conventional external configuration, comprising a substantially arcuate top 12 having legs 14, 14' extending downwardly, and a substantially horizontal base 16 connecting legs 14, 14'. Top 12 may include an aperture 18 through the apex thereof, which provides an attachment point whereby the stirrup 10 may be secured to a saddle (not shown), such as by a conventional stirrup leather (not shown). A pad 20 may be provided, which may be fabricated of a cushioning material and may also include gripping ridges 22 for improving the frictional contact between the sole of the rider's footwear and the stirrup 10. In an alternative embodiment, pad 20 may be fabricated of metal, and include gripping ridges 22 machined thereon. In yet another embodiment (not shown), gripping ridges 22 may simply be machined or carved into a top surface of base 16.

Figure 2:
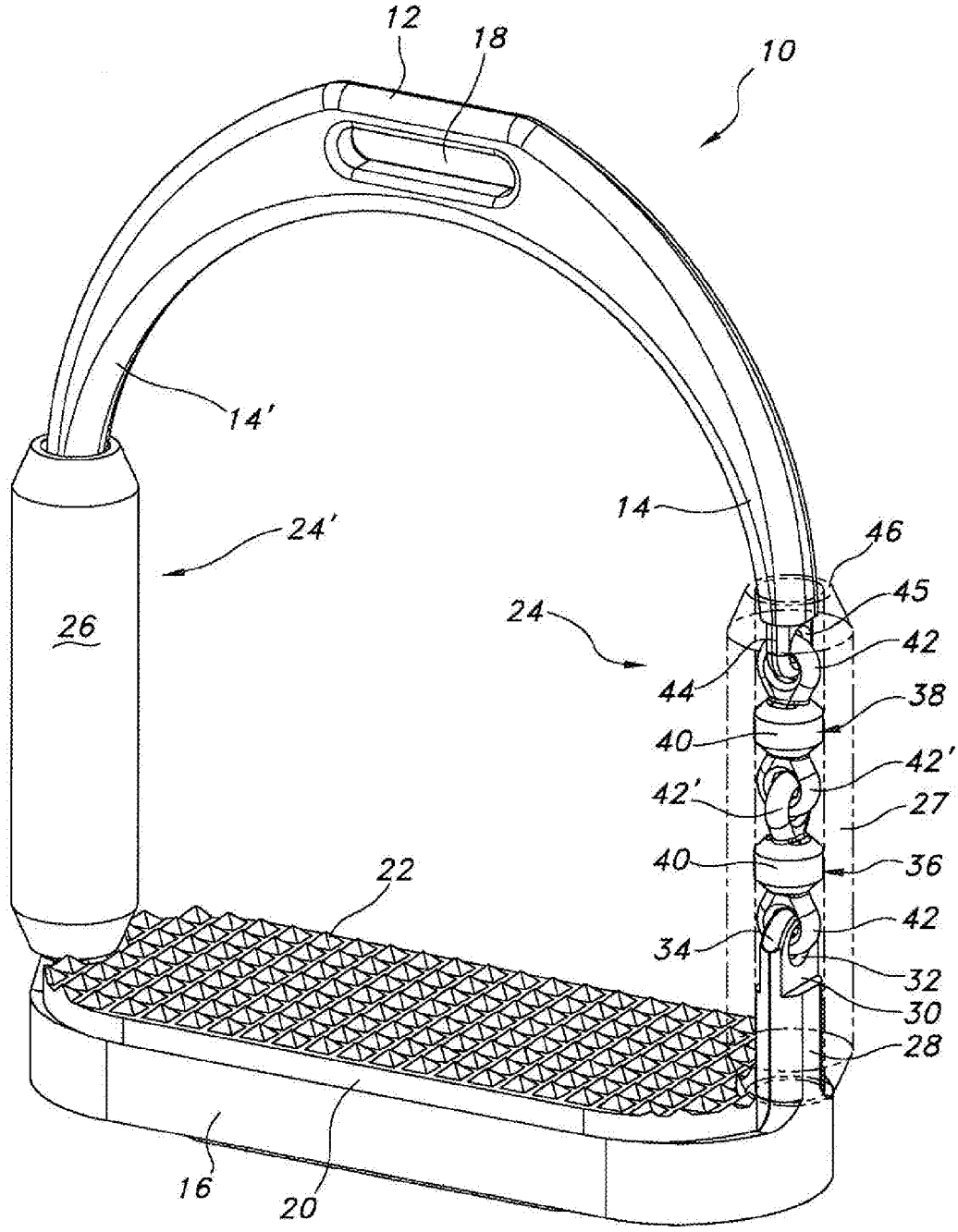
FIG. 2 shows the stirrup of FIG. 1, with the sheath covering the flexible section shown in phantom.

Stirrup 10 further includes two flexible sections 24, 24' connecting top 12 to base 16. Referring now to FIGS. 1 and 2, flexible sections 24, 24' include at least one connector connecting legs 14, 14' to base 16. The connector is typically enclosed in a hollow sheath 26 which, as will be described in greater detail below, stabilizes the flexible sections 24, 24'.

Referring to FIG. 2, one of the sheaths 26 is depicted in phantom to illustrate the configuration of an embodiment of flexible sections 24, 24'. An upstanding post 28 terminating in a flattened area 30 extends upwardly from base 16, with flattened area 30 having an aperture 32 therethrough. Flattened area 30 may include a rounded top 34. In the depicted embodiment, two connectors 36, 38 are provided. Each connector 36, 38 includes a stem 40 having couplers 42, 42' positioned at opposed ends thereof, with each of couplers 42, 42' including apertures 43 therethrough. In the depicted embodiment, couplers 42, 42' are configured as rounded eyelets. Further, in the depicted embodiment stem 40 includes a cross-sectional dimension which is at least as great as a cross-sectional dimension of couplers 42, 42'.

Figure 3:
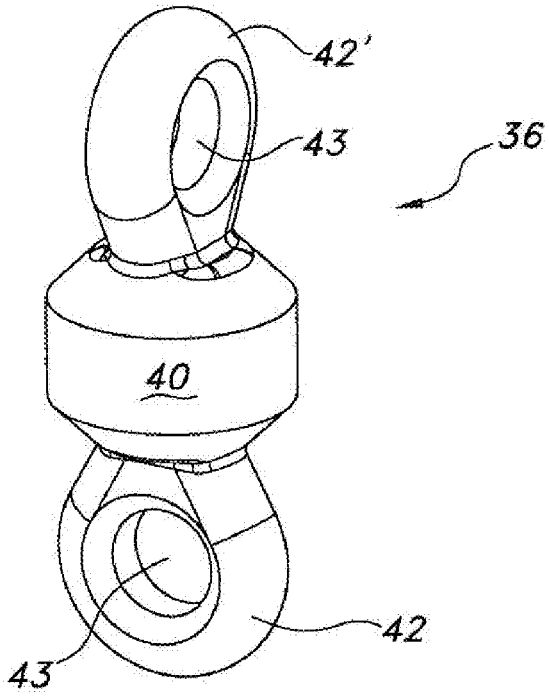
FIG. 3 shows a connector of the present invention in isolation.
Figure 4:
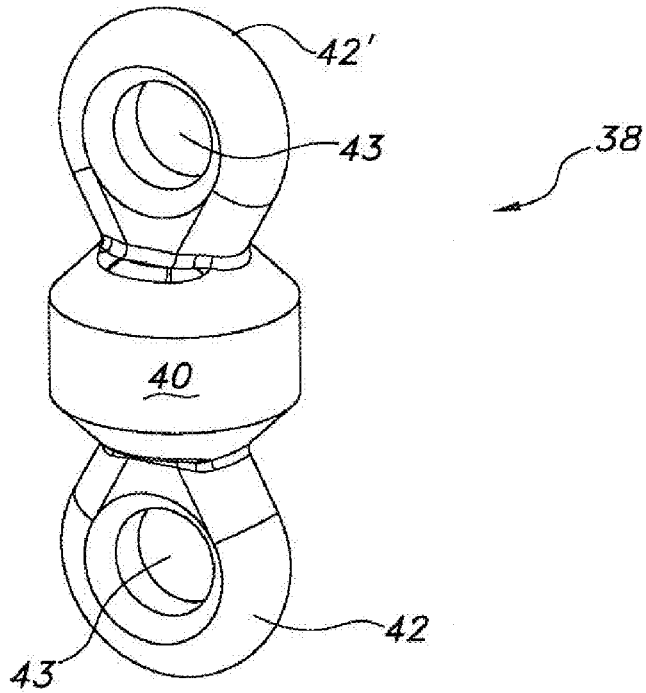
FIG. 4 shows a second type of connector in isolation.

Each of legs 14, 14' terminates in an end 44 having a central aperture therethrough 45. End 44 may also be configured as a rounded eyelet. It will be appreciated that in use couplers 42, 42', flattened area 30, and end 44 are linked as shown in FIG. 2. It will be further appreciated that this rounded eyelet configuration of couplers 42, 42', end 44, and the rounded top 34 of post 28 allows for a smoother path of travel when these features are pivotally linked to one another, although alternative configurations are possible. Couplers 42, 42' of connector 38 are oriented in a substantially similar plane such that apertures 43 face substantially in the same direction (see FIG. 4). Referring to FIG. 3, it can be seen that coupler 42 of connector 36 is oriented in a first plane, whereas coupler 42' of connector 36 is oriented in a second plane which is different from that of coupler 42 such that apertures 43 do not face substantially in the same direction. In the depicted embodiment as shown in FIG. 3, coupler 42' is oriented in a second plane which is substantially at a right angle to the first plane. In use, flexible sections 24, 24' are configured as shown in FIG. 2, with connector 36 connected to post 28 and to connector 38, and with connector 38 connected to arms 14, 14' by linking adjoining couplers 42, 42' to one another, to end 44, and to flattened area 30. It will be appreciated that the different orientations of the couplers 42, 42' allows linking to an adjoining connector 38 while preserving a smooth pivoting motion between the two connectors 36, 28. Of course, it will be appreciated also that fewer or more than two connectors could be used to adjust the degree of flexibility of the stirrup 10 as desired.

Yet another feature of the stirrup 10 of this invention will now be described. As shown in FIG. 2, hollow sheath 26 includes an internal channel 46 for enclosing the flexible sections 24, 24', the internal channel 46 defining an internal surface. At least a portion of connectors 36 and 38 define an external surface having a sufficient cross-sectional dimension such that frictional contact, i.e., a friction fit or interference fit, is maintained between the portion of the external surface of the connectors 36, 38 and a portion of the internal surface of the internal channel 46, whereby sheath 26 is retained in position. Posts 28, couplers 42, 42', and end 44 may also define an external surface sufficient to maintain a frictional contact between at least a portion of those features and a portion of the internal surface of internal channel 46. It will be appreciated that alternative configurations are equally suited. For example, one or more of stems 40, couplers 42, 42', and end 44 may define an external surface greater than an internal diameter of internal channel 46, whereby frictional contact is maintained therebetween.

Sheath 26 is typically fabricated of a flexible material, such as for example rubber or another suitable elastomer. It will be appreciated that the degree of flexibility of the selected material for sheath 26 will depend on the thickness of the side wall 27 of sheath 26. In other words, a sheath 26 having a thinner side wall 27 may require a material having a lesser degree of flexibility to provide the desired stabilizing function for stirrup 10, whereas a thicker sheath 26 may require a material having a greater degree of flexibility to provide the degree of stabilization required. The material of which sheath 26 is fabricated is typically selected to have a Shore hardness providing a desired degree of support for flexible sections 24, 24' such that unrestricted free movement of flexible sections 24, 24' is prevented. Typically, a material is selected from the group of flexible materials having a Shore hardness of at least 50.

Sheath 26 will also be typically selected from the group of materials having a suitable tackiness property, whereby frictional contact between the sheath 26 and the connectors 36 and 38 is maintained. It may be desirable to select a material having a tackiness which allows such frictional contact during use by a rider, but which still allows the sheath 26 to be moved to expose connectors 36 and 38 for examination and/or repair. It will also be appreciated that a sheath 26 of a suitable thickness and tackiness will allow contact between sheath 26 and one or both sides of a rider's foot, further improving the retention of the rider's foot in the stirrup 10.

Figure 5A:
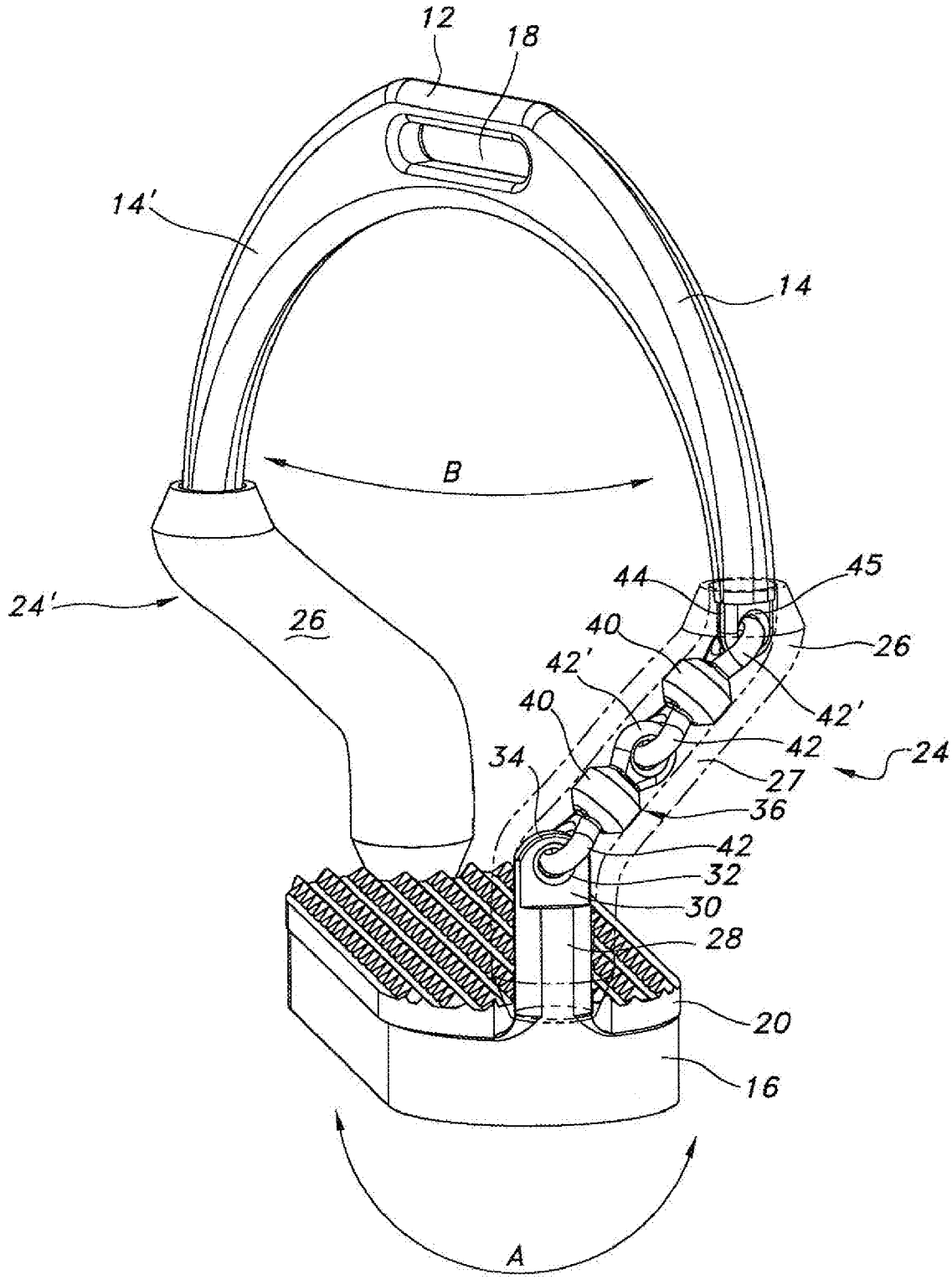
FIG. 5 illustrates torsional and rocking motion (FIG. 5A) and lateral motion (FIG. 5B) of the stirrup of the present invention.
Figure 5B:
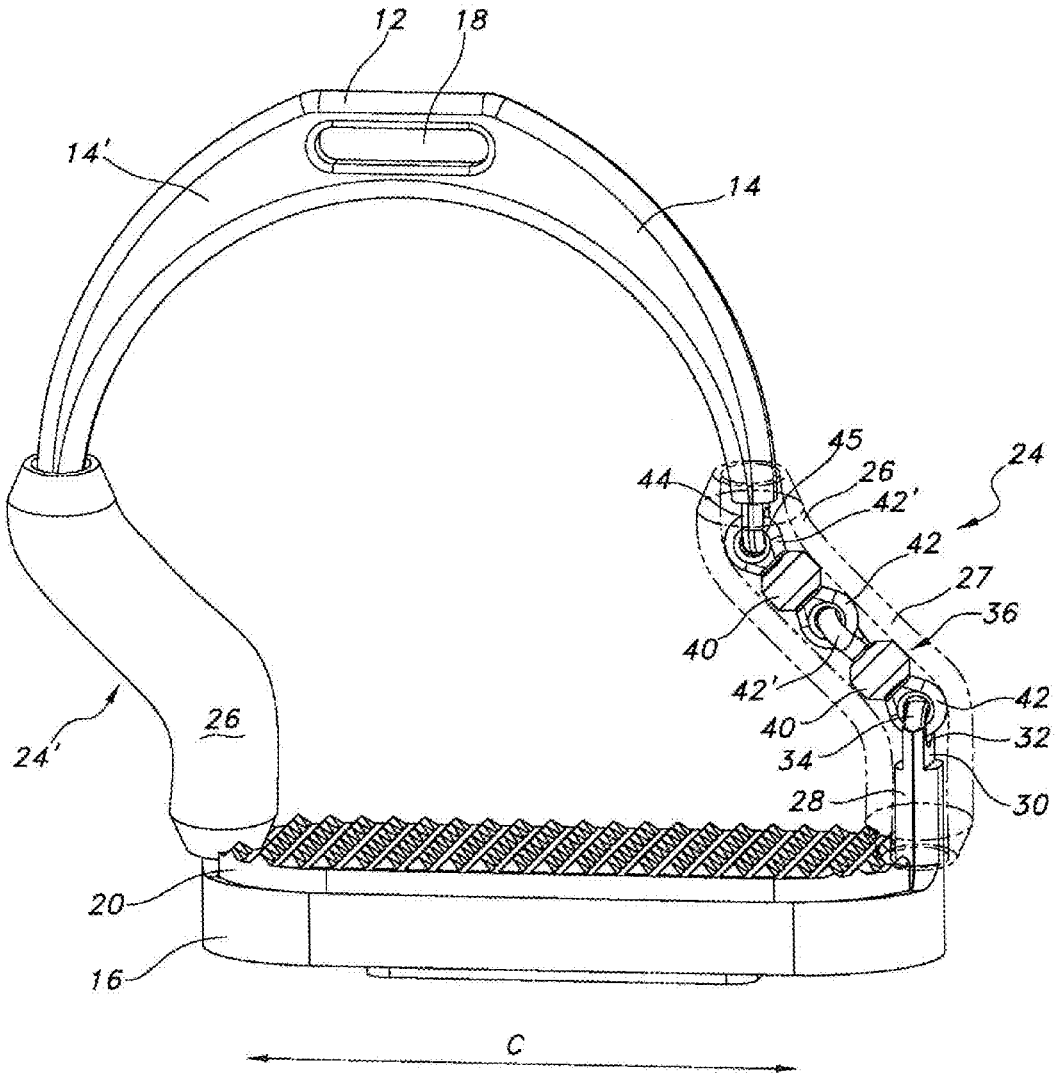

Referring to FIGS. 5A and 5B, the range of motion allowed by the present invention is shown. Those of skill in the art will recognize that because of the manner in which the connectors 36, 38 are interconnected with one another and with base 16 and legs 14, 14' respectively, a range of motion in at least six directions is possible. Specifically, base 16 may pivot forwards and backwards, in a rocking or see-saw motion relative to top 12 (Arrow A in FIG. 5A). Further, because of the flexibility imparted by the flexible sections 24, 24', base 16 may be moved in a clockwise and counterclockwise twisting or torsional motion relative to top 12 (Arrow B in FIG. 5A). Still further, base 16 may be moved left and right in a lateral direction relative to top 12 (Arrow C in FIG. 5B). Accordingly, a greater range of motion is provided to stirrup 10 in comparison to prior art flexible stirrups which allows the individual rider to position the elements of stirrup 10 properly for his or her maximum comfort and stability, while still allowing greater ease in assuming the proper heels-down riding position.

The foregoing description has been presented for purposes of illustration and description. It is not intended to be exhaustive or to limit the invention to the precise form disclosed. Obvious modifications or variations are possible in light of the above teachings. The described embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the foregoing description and appended claims, when interpreted in accordance with the breadth to which they are fairly, legally and equitably entitled.

What is claimed is:

1. A flexible stirrup for equitation, comprising:

a base for supporting a rider's foot;

a top for connecting to a stirrup leather;

two laterally spaced flexible sections connecting the base and the top each section including an intermediate cylindrical portion extending along a longitudinal axis of the flexible sections; and a hollow sheath having an internal surface in direct stabilizing frictional contact with intermediate cylindrical portion of the two laterally spaced flexible sections.

2. The stirrup of claim 1, wherein each of the two laterally spaced flexible sections comprises at least one connector comprising a unitary stem having a first coupler at a first end and a second coupler at a second, opposed end.

3. The stirrup of claim 2, wherein the two laterally spaced flexible sections comprise at least two connectors.

4. The stirrup of claim 2, wherein the unitary stem and first and second couplers have at least one cross-sectional dimension that is substantially equal.

5. The stirrup of claim 2, wherein at least a portion of the stirrup top, the stirrup base, the at least one connector are in stabilizing frictional contact with at least a portion of an internal surface of the hollow sheath.

6. The stirrup of claim 5 wherein the sheath is fabricated of a flexible material having a Shore hardness value of at least 50.

7. A flexible stirrup for equitation, comprising:

a base for supporting a rider's foot;

a top for connecting to a stirrup leather;

two laterally spaced flexible sections connecting the base and the top, the two laterally spaced flexible sections each comprising at least two coupled connectors each comprising a unitary stem having a coupler at a first end and at a second opposed end and an intermediate cylindrical portion; and a hollow sheath having an internal surface in direct stabilizing frictional contact with at least a portion of the intermediate cylindrical portion of the at least two coupled connectors;

further wherein at least a portion of the stirrup top, the stirrup base, and at least one of the at least two coupled connectors is in stabilizing frictional contact with at least a portion of an internal surface of the hollow sheath.

8. The stirrup of claim 7, wherein the stein and first and second couplers of each connector have at least one cross-sectional dimension that is substantially equal.

9. The stirrup of claim 7, wherein the sheath is fabricated of a flexible material having a Shore hardness value of at least 50.

10. The stirrup of claim 7, wherein at least one of the stem and first and second couplers of each connector have at least one external dimension sufficient to maintain a friction fit or interference fit between at least a portion of the connector external surface and at least a portion of the hollow sheath internal surface.

11. The stirrup of claim 7, wherein each hollow sheath encloses and stabilizes an entirety of each of the two laterally spaced flexible sections.

12. A flexible stirrup for equitation, comprising:

a base for supporting a rider's foot;

a top for connecting to a stirrup leather; and two laterally-spaced flexible sections connecting the base and the top;

wherein each flexible section comprises at least two coupled connectors;

and each connector comprises a unitary cylindrical stem having a coupler at a first end and at a second opposed end;

further wherein at least a portion of a central circumference the unitary stem is in direct stabilizing frictional contact with at least a corresponding portion of an internal surface of a hollow sheath.

13. The stirrup of claim 12, wherein the stem and first and second couplers of each connector include at least one cross-sectional dimension that is substantially equal.

14. The stirrup of claim 12, wherein the sheath is fabricated of a flexible material having a Shore hardness value of at least 50.

15. The stirrup of claim 12, wherein at least a portion of of the stirrup top, the stirrup base, and at least one of the at least two coupled connectors is in stabilizing frictional contact with at least a portion of an internal surface cif the hollow sheath.

16. The stirrup of claim 15, wherein at least one of the stem and first and second couplers of each connector have at least one external dimension sufficient to maintain a friction fit or interference fit between at least a portion of the connector external surface and at least a portion of the hollow sheath internal surface.

17. The stirrup of claim 12, wherein the hollow sheath encloses and stabilizes an entirety of each flexible section.

* * * * *

UNITED STATES PATENT AND TRADEMARK OFFICE

CERTIFICATE OF CORRECTION

PATENT NO. : 7,543,427 B2
APPLICATION NO. : 11/325222
DATED : June 9, 2009
INVENTOR(S) : Isidore Strauss It is certified that error appears in the above-identified patent and that said Letters Patent is hereby corrected as shown below:

Claim 15, column 8, line 4, please delete second "of" in sentence.

Claim 15, column 8, line 7, please replace "cif" with -- of --.

Signed and Sealed this

Fourth Day of August, 2009

John Doll

JOHN DOLL
*Acting Director of the United States Patent and Trademark Office*